US010386124B2

(12) United States Patent
Stark

(10) Patent No.: US 10,386,124 B2
(45) Date of Patent: Aug. 20, 2019

(54) DUAL PASS OPPOSED (REVERSE) FLOW COOLING COIL WITH IMPROVED PERFORMANCE

(71) Applicant: Kentuckiana Curb Company, Inc., Louisville, KY (US)

(72) Inventor: Walter Stark, Huntington, NY (US)

(73) Assignee: Kentuckiana Curb Company, Inc., Louisville, KY (US)

( * ) Notice: Subject to any disclaimer, the term of this patent is extended or adjusted under 35 U.S.C. 154(b) by 185 days.

(21) Appl. No.: 15/424,247

(22) Filed: Feb. 3, 2017

(65) Prior Publication Data

US 2017/0241714 A1 Aug. 24, 2017

Related U.S. Application Data

(60) Provisional application No. 62/298,282, filed on Feb. 22, 2016.

(51) Int. Cl.
*F28F 1/32* (2006.01)
*F28D 1/047* (2006.01)

(52) U.S. Cl.
CPC ..... *F28F 1/32* (2013.01); *F28D 1/0477* (2013.01); *F28F 2215/04* (2013.01); *F28F 2250/102* (2013.01)

(58) Field of Classification Search
CPC .... F28D 1/0477; F28D 9/0093; F28D 9/0068; F28F 2215/04; F28F 2205/108
See application file for complete search history.

(56) References Cited

U.S. PATENT DOCUMENTS

| | | | | |
|---|---|---|---|---|
| 5,816,315 | A * | 10/1998 | Stark | F24F 3/1405 165/66 |
| 5,915,469 | A * | 6/1999 | Abramzon | B64D 13/00 165/134.1 |
| 9,377,250 | B2 * | 6/2016 | Landre | F28F 3/025 |
| 2013/0098093 | A1 * | 4/2013 | Stark | F28F 17/005 62/285 |
| 2013/0112373 | A1 * | 5/2013 | Fukai | H01L 23/427 165/104.21 |

* cited by examiner

*Primary Examiner* — Elizabeth J Martin
(74) *Attorney, Agent, or Firm* — Middleton Reutlinger

(57) ABSTRACT

A dual pass heat exchanger for cooling and dehumidifying an airstream has adjacent passes for air flow in which air flow is in opposite directions being counter-flow and parallel-flow passes. A cooling coil contains flowing chilled liquid refrigerant extending through all of the passes, and the coiling coil has fins on outer surfaces thereof for promoting efficient thermal transfer, whereby density of the fins in the counter-flow passes is greater than density in the parallel-flow passes, whereby fin density is varied in fin style, locational density, thickness and/or depth.

17 Claims, 4 Drawing Sheets

IMPROVED PERFORMANCE
FIN DENSITY INCREASED ON COUNTER-FLOW PASSES, AND DECREASED ON PARALLEL-FLOW PASSES

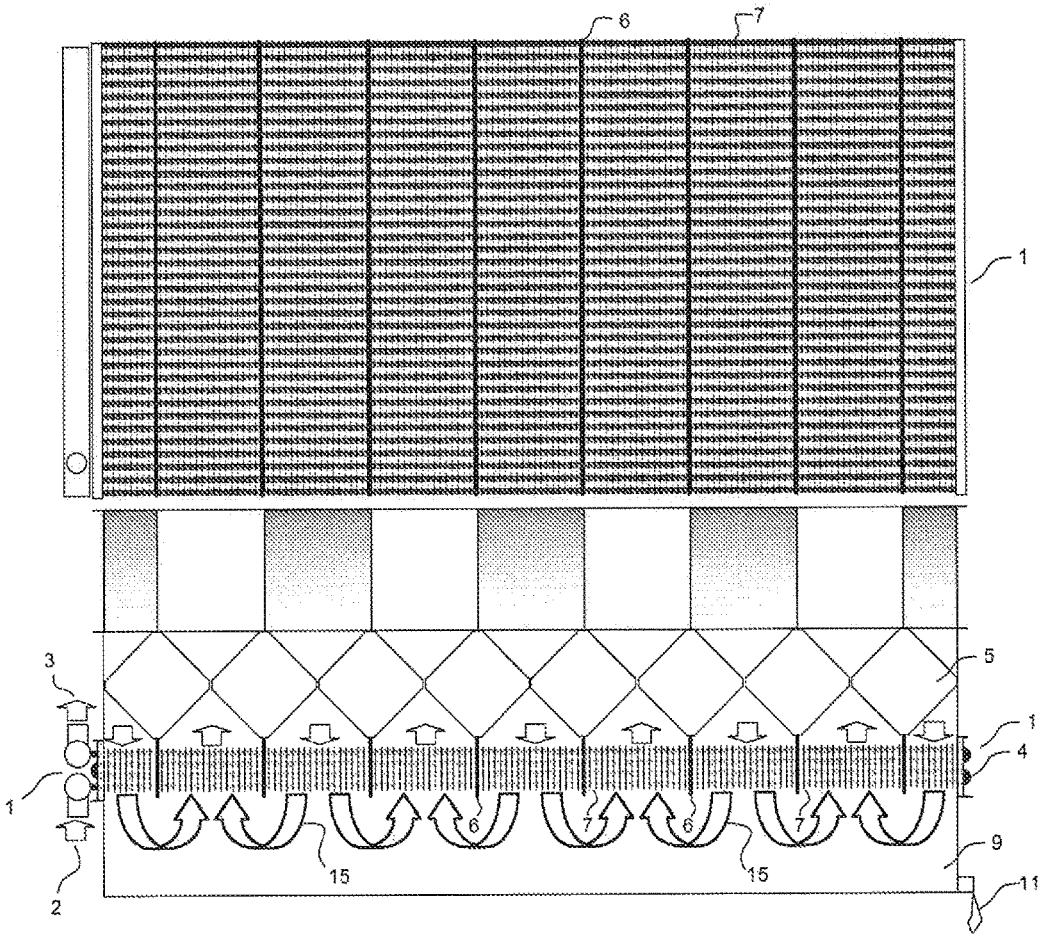
FIGURE 1 - PRIOR ART
EQUAL FIN DENSITY ON BOTH COUNTER-FLOW AND PARALLEL-FLOW PASSES

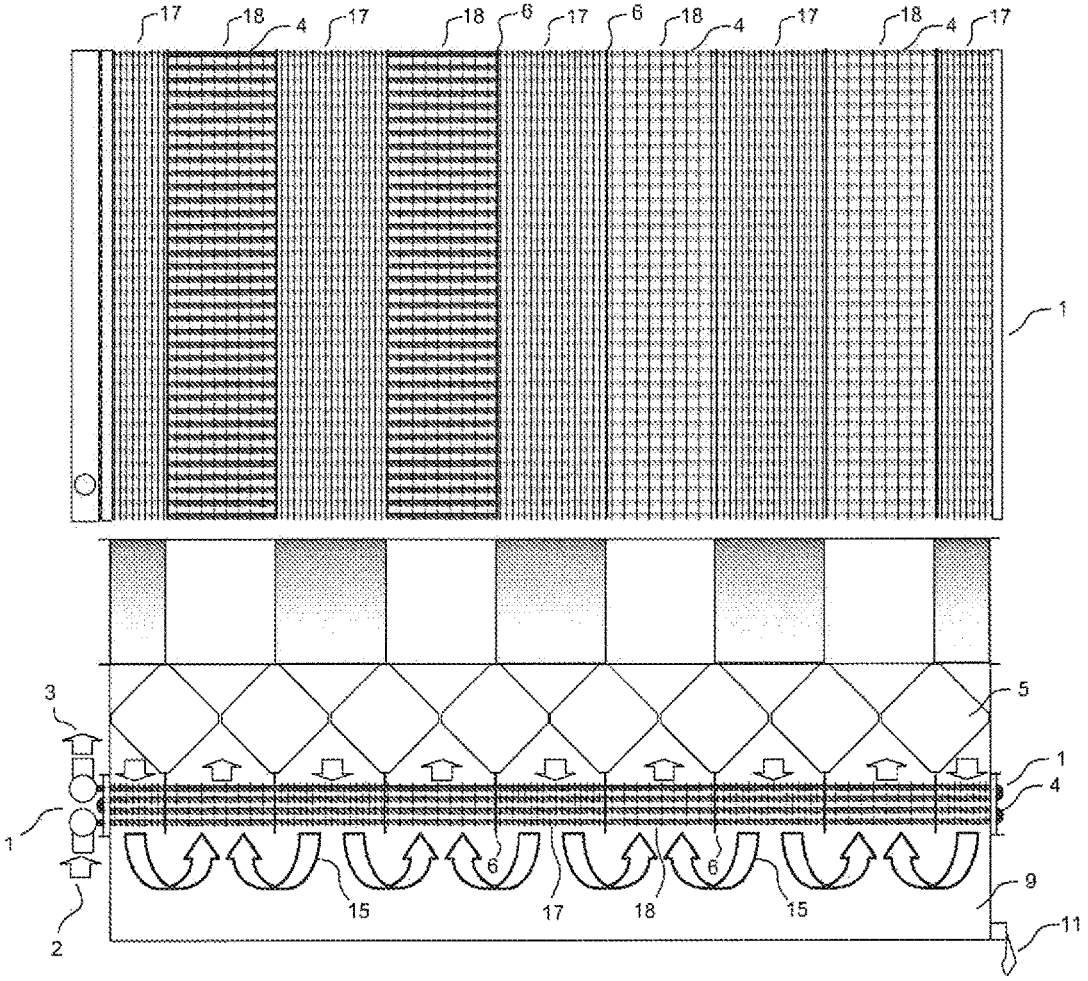
FIGURE 2 - IMPROVED PERFORMANCE
FIN DENSITY INCREASED ON COUNTER-FLOW PASSES, AND DECREASED ON PARALLEL-FLOW PASSES

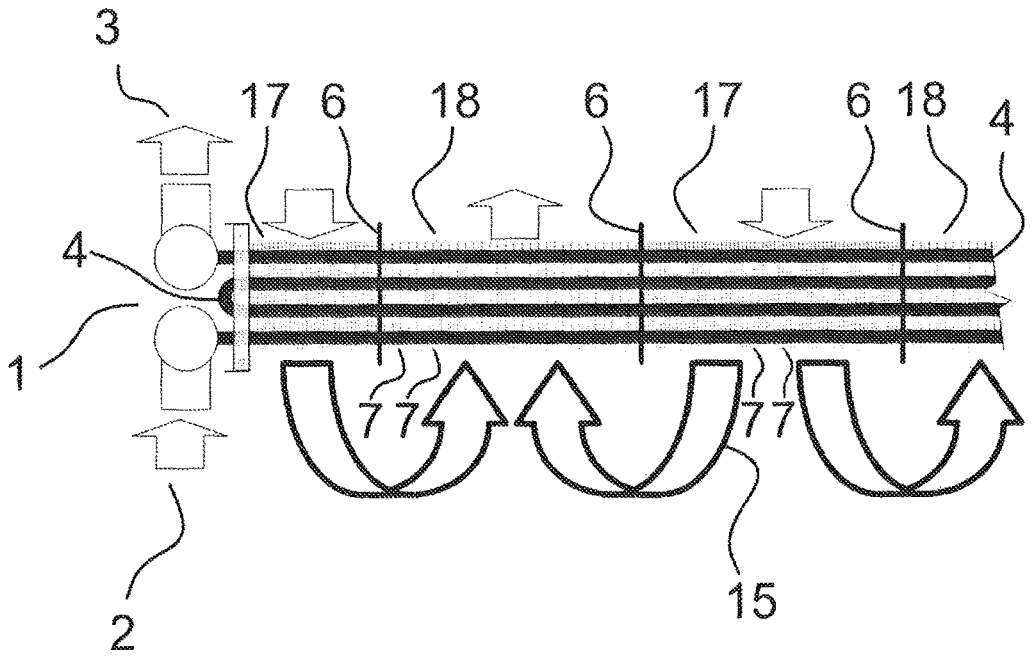
FIGURE 3 – SECTION SHOWING DETAIL OF VARYING FIN DENSITY

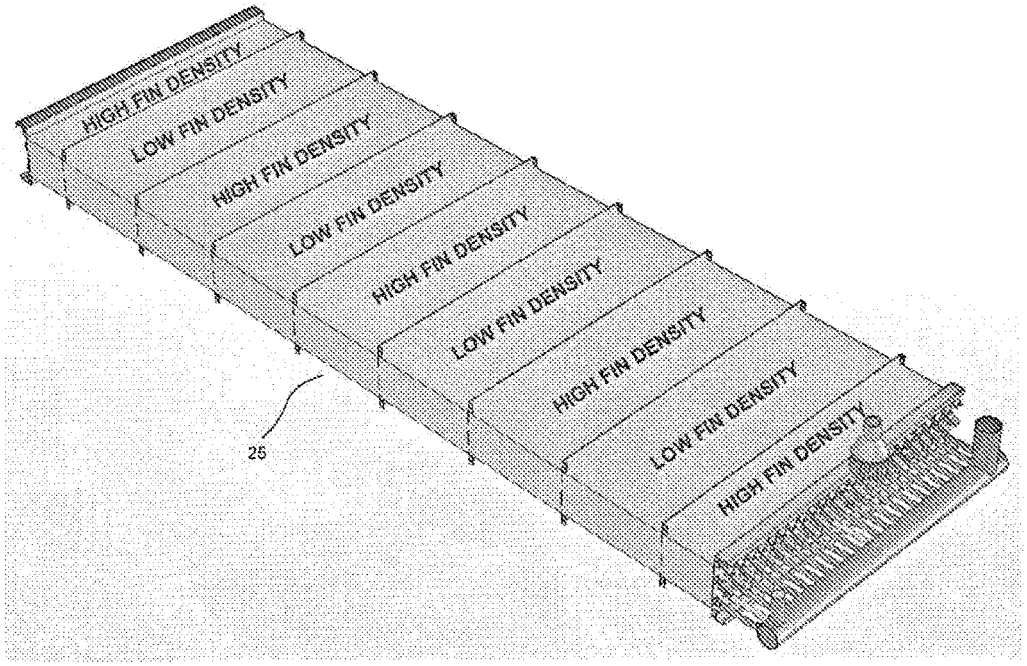
FIGURE 4 - IMPROVED PERFORMANCE
HIGH FIN DENSITY ON COUNTER-FLOW PASSES, AND LOW FIN DENSITY ON PARALLEL-FLOW PASSES

DUAL PASS OPPOSED (REVERSE) FLOW COOLING COIL WITH IMPROVED PERFORMANCE

RELATED APPLICATIONS

This applications claims benefit under 35 USC § 119 (e) from provisional application No. 62/298,282, filed Feb. 22, 2016. The '282 application is incorporated by reference herein.

FIELD OF THE INVENTION

The present invention relates to improved dual pass opposed (reverse) flow cooling coil with reduced overall air pressure drop.

BACKGROUND OF THE INVENTION

This patent application relates to improvements to the performance of U.S. Pat. No. 5,816,315 of Stark, dated Oct. 6, 1998, which teaches a two pass opposed (reverse) flow cooling coil with uniform heat transfer Media serving each pass) one pass of coolant flow being parallel to airflow and the other pass of coolant flow being counter to airflow.

Finned-tube coils used for air cooling and dehumidifying are typically selected based on thermal performance. A given set of inlet temperature and humidity conditions are cooled to a given set of outlet temperature and humidity conditions.

The terms "counter-flow" and "parallel-flow" refer to temperature flow (Thermal) rather than fluid flow.

Unlike water cooling coils, in refrigerant cooling coils the refrigerant temperature drops, relative to its pressure drop, as it moves through the coil. Therefore, the fluid flow in a refrigerant coil is parallel to airflow, while the temperature is counter-flow.

"Counter-flow" is defined as the flow pattern where the air temperature drop flows counter (opposite direction) to the fluid temperature rise. This is also referred to as "Thermal" counter-flow.

"Parallel-flow" is defined as the flow pattern where the air temperature drop flows parallel (same direction) to the fluid temperature rise. This is also referred to as "Thermal" parallel-flow.

Air travels either parallel or counter, relative to tube side coolant flow.

The parallel-flow pass is known to be the least efficient but nevertheless contributes to improving the overall thermal performance, while disimproving overall air pressure drop.

Fins for finned tube heat exchangers can vary in style, density, thickness and depth. Examples of fin styles are flat, corrugated and louvered. Fin styles can improve performance by creating turbulence. The best styles improve heat transfer with minimal impact on pressure drop. Fin density is the number of fins per inch (FPI). Increasing fin density improves heat transfer by increasing heat transfer surface; they also occupy more space in the direction of airflow, thereby increasing air velocity and turbulence. Fin thickness relates to turbulence because thicker fins occupy more space in the direction of airflow, thereby increasing air velocity and turbulence. Fin depth is related to the number of rows in a coil, which increases or decreases the finned surface area. Collectively, the various combinations of fin style, density, thickness and depth are referred to herein as "Finned Media Configuration". Improving or disimproving "Finned Media" refers to Improving or disimproving pressure drop, heat transfer, both or a combination.

Air pressure drop occurs as it travels through the finned media. This pressure drop increases or decreases the fan power needed to move air through the process.

Pressure drop and heat transfer are related in the sense that greater pressure drop generally results in greater heat transfer. However, pressure drop in a parallel-flow pass is less effective on overall heat transfer, when compared with pressure drop in a counter-flow pass.

A value could be expressed as unit of heat transfer/unit of pressure drop (BTU/Inch water column). When the value in the parallel-flow sections result in a value approaching the counter-flow sections, the Finned Media in both passes are optimized. This technique would be incorporated into the overall system design phase of dual-pass installations benefitting from this invention.

OBJECTS OF THE INVENTION

Therefore, enhancements that increase pressure drop and heat transfer are more useful when placed in the counter-flow pass.

With uniform finned media on both passes, air pressure drop—per unit of thermal performance—is higher in the parallel airflow pass when compared with the counter airflow pass. If only counter-flow were used; for a given thermal performance air pressure drop would decrease, making a higher performing system.

Other objects will become apparent from the following description of the present invention.

SUMMARY OF THE INVENTION

In keeping with these objects and others which may become apparent, the purpose of this invention is to increase heat transfer through the counter-flow pass while keeping the overall pressure drop low. The parallel-flow pass could have unfinned sections for reducing thermal performance and air pressure drop. The Finned Media would be in the counter-flow air passes and the unfinned sections in the parallel-flow air passes. Alternatively, the unfinned sections can be replaced by sections having reduced Finned Media Configuration, compared to the counter-flow sections with increased Finned Media Configuration.

To compensate for the loss of thermal performance in the parallel air pass, the Finned Media of the counter-flow airflow passes would be improved by changing the Finned Media Configuration.

The net result is improved thermal performance resulting in lower air pressure drop, thereby saving fan energy.

The problem is that coils are typically manufactured with uniform Finned Media-across both counter and parallel sections. To be effective, the Finned media configuration should be weighted toward counter-flow sections where the benefits, in the form of overall reduced pressure drop, are greatest.

The Finned Media in a counter-flow section perform better than the same Finned Media Configuration in a parallel-flow section. Therefore, moving fins from the parallel-flow section to the counter-flow section will reduce total pressure drop for a given thermal performance.

Because of the reduction in air pressure drop as it travels, over the Finned Media, there is a reduced need for fan power to move air through the process, by a factor of at least 10% percent or more.

BRIEF DESCRIPTION OF THE DRAWINGS

The present invention can best be understood in connection with the accompanying drawings. It is noted that the invention is not limited to the precise embodiments shown in drawings, in which:

FIG. 1 is a side diagrammatic view of a Prior Art heat exchanger above a chilled water cooling coil with air flow fins, with equal Finned Media on both the counter-flow and parallel-flow passes.

FIG. 2 is a side diagrammatic view of the present invention showing a heat exchanger above a chilled water cooling coil with air flow fins, where the Finned Media is improved on counter-flow passes, and disimproved on parallel-flow passes.

FIG. 3 is an enlarged side internal elevation of the cooling coil of FIG. 2 showing clearly the different fin density in the counter-flow regions as compared to that of the parallel-flow regions of air flow.

FIG. 4 is a perspective view showing improved performance of the heat exchanger above a refrigerant cooling coil, wherein a high fin density is provided on counter-flow passes and a low fin density is provided on parallel-flow passes, wherein the counter-flow pass regions alternate with the parallel-flow regions.

DETAILED DESCRIPTION OF THE DRAWINGS

A prior art diagrammatic view of a heat exchanger above a chilled water cooling coil is shown in FIG. 1. The bottom section of FIG. 1 shows a side elevation with a cooling coil 1. A top view of coil 1 is shown above the bottom section (and in registration with it). The fins 7, attached to coolant tubes 4, have the same Finned Media on both counter-flow and parallel-flow passes. Chilled water enters at 2 and leaves at 3. Air flow is indicated by wide arrows 15 and is shown entering and leaving the plenum area 9 under coil 1. Parallel-flow and counter-flow air paths are being separated by dividers 6. Above coil 1 is a line of adjacent air heat exchangers 5. Condensate is shown as 11 leaving the plenum 9 area.

A diagrammatic view of the present invention is shown in FIG. 2. The format of FIG. 2 matches that of prior art FIG. 1 to clearly distinguish the improvement. Here again a top view of chilled water cooling coil 1 is shown above, the side elevation of the dual pass system. Parallel-flow and counter-flow air paths are being separated by dividers 6. The change is that the finned Media of the counter-flow passes has been improved relative to the finned Media of the parallel-flow passes. Finned Media 17 of the counter-flow regions is shown next to the decreased finned Media 18 of the parallel-flow sections. The better control of pressure drops and heat transfer of the systems according to FIG. 2 improve thermal and overall efficiency.

A sectional view of the present invention is shown in FIG. 3 for clarity. The fins 7 are shown as vertical line segments attached to coolant tubes 4. The spacing of fins 7 can be seen more clearly in this view. Fins 7 are spaced much closer together in counter-flow regions 17 and are spaced farther apart in parallel-flow regions 18. While shown with lower fin density in regions 18 in this view, as mentioned earlier these parallel-flow regions could be totally unfinned.

The perspective view (FIG. 4) of a refrigerant coil 25 with alternating low and high fin densities shows that a similar technique can be used on refrigerant coils. The high fin density regions are in registration with counter-flow regions while the low fin density regions are in registration with parallel-flow regions.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention.

I claim:

1. A dual pass heat exchanger for cooling and dehumidifying an airstream comprising:

said heat exchanger having adjacent passes for air flow in which air flow is in opposite directions being counter-flow and parallel-flow passes;

a cooling coil containing flowing chilled liquid refrigerant extending through all of said passes, said cooling coil having external fins on outer surfaces thereof for promoting efficient thermal transfer; and a first density of said external fins in said counter-flow passes being greater than a second density of said external fins in said parallel-flow passes.

2. The heat exchanger of claim 1 in which said refrigerant is chilled water.

3. The heat exchanger of claim 1 in which said passes are parallel to each other.

4. The heat exchanger of claim 3 having a plenum area at one end of said heat exchanger, said air flow reversing direction in said plenum in moving from one pass to adjacent passes.

5. The heat exchanger of claim 4 in which said plenum has an opening for draining condensate.

6. The heat exchanger of claim 1 wherein said fins having said first density in said counter-flow passes are provided closer together than said fins having said second density in said parallel-flow passes.

7. The heat exchanger of claim 1 wherein said fins having said first density in said counter-flow passes occupy more space in the direction of airflow than said fins having said second density in said parallel-flow passes, thereby increasing air velocity and turbulence.

8. The heat exchanger of claim 1 wherein each said fin of said fins having said first density in said counter-flow passes has a first width perpendicular to the direction of airflow and each said fin of said fins having said second density in said parallel-flow passes has a second width perpendicular to the direction of airflow, wherein said first width is greater than said second width thereby providing increased turbulence and increased air velocity.

9. A method for cooling and dehumidifying an airstream comprising the steps of:

providing a heat exchanger with multi-passes for air flow, adjacent said passes in which air flow is in opposite directions being counter-flow and parallel-flow passes;

providing a cooling coil containing flowing chilled liquid refrigerant extending through all of said passes, said coiling coil having external fins on outer surfaces thereof for promoting efficient thermal transfer; and providing a first density of said fins in said counter-flow passes greater than a second density of said fins in said parallel-flow passes.

10. The method of claim 9 in which said refrigerant is chilled water.

11. The method of claim 9 in which said passes are arranged to be parallel to each other.

12. The method of claim 11 in which a plenum area is provided at one end of said heat exchanger for reversing direction of said air flow in said plenum in moving from one pass to adjacent passes.

13. The method of claim 12 in which an opening is provided in said plenum for draining condensate.

14. The method of claim 9 further comprising the step of providing said fins having said first density in said counter-flow passes are closer together than said fins having said second density in said parallel-flow passes.

15. The method of claim 9 further comprising the step of providing said fins having said first density in said counter-flow passes occupy more space in the direction of airflow than said fins having said second density in said parallel-flow passes, thereby increasing air velocity and turbulence.

16. The method of claim 9 further comprising the step of providing each said fin of said fins having said first density in said counter-flow passes has a first width perpendicular to the direction of airflow and each said fin of said fins having said second density in said parallel-flow passes has a second width perpendicular to the direction of airflow, wherein said first width is greater than said second width thereby providing increased turbulence and increased air velocity.

17. A dual pass heat exchanger for cooling and dehumidifying an airstream comprising:

said heat exchanger having adjacent passes for air flow in which air flow is in opposite directions being counter-flow and parallel-flow passes;

a cooling coil containing flowing chilled liquid refrigerant extending through all of said passes, said coiling coil having external fins on outer surfaces thereof for promoting efficient thermal transfer; and said external fins positioned only in said counter-flow passes.

* * * * *